US011329740B2

(12) United States Patent
Hock

(10) Patent No.: US 11,329,740 B2
(45) Date of Patent: May 10, 2022

(54) RETROFITTING LEGACY CAR RADIO TO RECEIVE DIGITAL AUDIO BROADCASTS

(71) Applicant: Darryl Hock, Sterling Heights, MI (US)

(72) Inventor: Darryl Hock, Sterling Heights, MI (US)

(73) Assignee: Darryl Hock, Sterling Heights, MI (US)

( * ) Notice: Subject to any disclaimer, the term of this patent is extended or adjusted under 35 U.S.C. 154(b) by 0 days.

(21) Appl. No.: 16/643,010

(22) PCT Filed: May 14, 2019

(86) PCT No.: PCT/US2019/032158

§ 371 (c)(1),
(2) Date: Feb. 28, 2020

(87) PCT Pub. No.: WO2020/009745

PCT Pub. Date: Jan. 9, 2020

(65) Prior Publication Data

US 2021/0384997 A1 Dec. 9, 2021

Related U.S. Application Data

(60) Provisional application No. 62/693,139, filed on Jul. 2, 2018.

(51) Int. Cl.
*H04H 40/18* (2008.01)
*H04H 60/41* (2008.01)

(52) U.S. Cl.
CPC ..... *H04H 40/18* (2013.01); *H04H 60/41* (2013.01); *H04H 2201/20* (2013.01)

(58) Field of Classification Search
CPC .... H04H 40/18; H04H 60/41; H04H 2201/20; H04B 1/082
See application file for complete search history.

(56) References Cited

U.S. PATENT DOCUMENTS 6,920,479 B2 * 7/2005 McDowall ..... H04L 65/4076 709/231
2017/0055077 A1 2/2017 Merricks et al.
2021/0099244 A1 * 4/2021 Zeng ..... G06F 3/165

FOREIGN PATENT DOCUMENTS

CN 106330369 A * 1/2017 ..... H04B 1/16
GB 2490145 A * 10/2012 ..... H04B 1/18
(Continued)

OTHER PUBLICATIONS

Roberts, RD-10 FM RDS/DAB Digital Radio, Jan. 1, 2004, XP055892825, p. 2, Line 1—p. 9, p. 11.
(Continued)

*Primary Examiner* — Sophia Vlahos
(74) *Attorney, Agent, or Firm* — Lorenz & Kopf LLP

(57) ABSTRACT

The conversion circuit adapts a legacy radio to play digital broadcasts using a sensing circuit coupled to a control device of the legacy radio to produce a control device position signal. A processor detects changes in this position signal and interprets a pattern of predetermined changes in position signals to generate at least digital radio broadcast scan command. The conversion circuit also includes a digital radio receiver that performs a scan operation in response to the scan command and supplies the processor with a channel list of detected digital stations. The processor associates each of the detected digital stations to a different positional setting of the control device. The processor also interprets different positional settings of the control device as a content selection commands, which it uses to cause the receiver to select a particular content component for playback through an audio amplifier.

18 Claims, 14 Drawing Sheets

(56) References Cited

FOREIGN PATENT DOCUMENTS

| | | | |
|---|---|---|---|
| KR | 20130010525 | A | 1/2013 |
| WO | 2005086394 | A1 | 9/2005 |

OTHER PUBLICATIONS

Gardner John et al., Digital Radio Technology For Innovators (TM), Jan. 1, 2005, XP055892829, p. 25.

* cited by examiner

RETROFITTING LEGACY CAR RADIO TO RECEIVE DIGITAL AUDIO BROADCASTS

CROSS-REFERENCE TO RELATED APPLICATION

This application is a U.S. National-Stage entry under 35 U.S.C. § 371 based on International Application No. PCT/US2019/032158, filed May 14, 2019 which was published under PCT Article 21(2) and which claims the benefit of U.S. Provisional Application No. 62/693,139 filed Jul. 2, 2018.

TECHNICAL FIELD

The present disclosure relates generally to radios for receiving public broadcasts. More particularly the disclosure relates to an electronic circuit for retrofitting legacy radios, such as car radios, with the components needed to receive digital audio broadcasts (DAB), while leaving legacy tuning knob and volume control knob intact and fully integrated with the DAB components.

BACKGROUND

This section provides background information related to the present disclosure which is not necessarily prior art.

On Dec. 13, 2017, Norway pulled the plug on its national FM radio broadcasting system, to become the first country to switch to an entirely new mode of public broadcasting: digital audio broadcasting or DAB. Norway was the first European country to make the switch. Other countries are making similar plans.

Much like the switch in the United States from analog to digital television, the switch to digital radio rendered hundreds of thousands of analog FM radio receivers obsolete. Although these legacy FM radios are still capable of receiving FM broadcasts, in Norway, at least, there are no longer any broadcasts to receive.

The switch from analog to digital radio promises to be particularly painful to owners of vintage automobiles. Owners of such radios highly value having a dashboard with a totally vintage look and feel. Replacing the vintage radio with a sparkling new DAB radio—complete with digital UP-DOWN tuning buttons and multicolor backlit LCD display—into the dashboard of a vintage Aston Martin would look jarringly anachronistic. It is this challenge that the present disclosure seeks to solve.

The disclosed electronic conversion circuit can supplement, or entirely replace, the electronic components of a legacy radio to provide support for digital audio broadcasts. While disclosed here in the context of an automotive radio application, the techniques disclosed can readily be used in other types of radios including tabletop radios. The disclosed electronic circuit addresses several incompatibilities between legacy radios and DAB radios.

These incompatibilities arise from the fact that a DAB radio is tuned digitally, by selecting a channel corresponding to a program contained within the DAB data stream, whereas the legacy radio is tuned by selecting a radio frequency from a range of frequencies allocated across an analog radio band. In DAB radio, multiple different radio stations transmit on the same frequency. Indeed, multiple different radio stations can use the same transmitter. In a DAB radio reception, the user "tunes" a station by digitally selecting the unique ID code for the desired station, all without changing receiver frequency. Such tuning is completely unlike how a vintage analog radio is tuned.

BRIEF SUMMARY

Therefore, in accordance with one aspect, disclosed is a conversion circuit for adapting a legacy radio to play digital broadcasts. The typical legacy radio has at least one manually manipulable control device associated with a tuning dial displaying a span of contiguous tuning frequencies. The digital broadcasts have associated with a carrier frequency an ensemble of plural stations each station providing different digital streaming content components. In this context, the disclosed conversion circuit includes a sensing circuit coupled to a control device of the legacy radio. The sensing circuit produces a signal indicative of the positional setting of the control device.

The conversion circuit further includes a processor coupled to the sensing circuit. The processor is programmed to detect changes in the positional setting of the control device and to interpret a pattern of predetermined changes in the positional and velocity settings to generate or produce at least one scan command.

The conversion circuit further includes a digital radio receiver circuit coupled to the processor and adapted, in response to a scan command from the processor, to tune to a reception frequency and perform a content scanning operation that accesses the data stream of at least one ensemble and to compile and communicate to the processor a channel list of detected digital stations.

In accordance with the present disclosure, the processor is programmed to associate each of the detected digital stations of the channel list to a different positional setting of the control device. The processor is further programmed to interpret each different positional setting of the control device as a content selection command. In accordance with the present disclosure, the digital radio receiver circuit is further adapted, in response to a content selection command from the processor, to select from the at least one ensemble a particular content component and cause the selected content to be played through an audio playback amplifier.

BRIEF DESCRIPTION OF THE DRAWINGS

The drawings described herein are for illustrative purposes only of selected embodiments and not all possible implementations. Thus the particular choice of drawings is not intended to limit the scope of the present disclosure.

Corresponding reference numerals indicate corresponding parts throughout the several views of the drawings.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

The disclosed electronic conversion circuit performs several functions. It supplements or replaces the legacy radio circuits with a digital audio broadcast DAB receiver. It repurposes the existing legacy volume, tone and tuning controls as position sensors. In combination with its onboard processor, the disclosed electronic circuit interprets different legacy volume, tone and tuning control knob twist sequences as metacommands that cause the electronic circuit to capture available DAB stations and distribute them across the analog tuning band of the legacy radio, thereby placing the DAB stations across the analog band as if they were analog AM or FM stations.

Because the legacy radio will typically have no alphanumeric display (such as an LCD display or LED display), the disclosed electronic conversion circuit provides user feedback audibly. In one embodiment, an included annunciator circuit generates a brief "plink" sound (or other such audible sound) when each digital station is "tuned" by dialing across the analog tuning band. If desired, the circuit generates and injects a hiss-like "comfort noise" between tuned stations, giving the impression that the space between the digital stations is filled with background noise as would be present in analog AM and FM radios.

The details of the disclosed electronic circuit and an explanation of how these foregoing functions are produced is presented below. However, before proceeding with that explanation, a discussion of legacy radios and of the manner in which DAB signals are delivered will first be provided.

Legacy AM and FM Radios

Figure 1A:
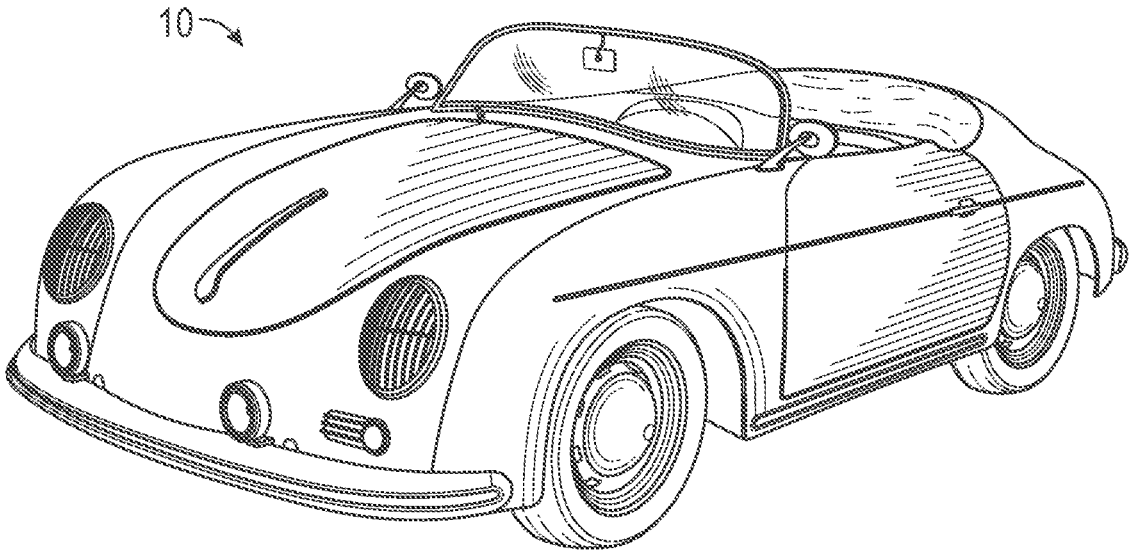
Fig. 1A (Prior Art)
FIG. 1A is a perspective view of a vintage automobile, useful in understanding the environment in which the disclosed electronic circuit may be deployed.
Figure 1B:
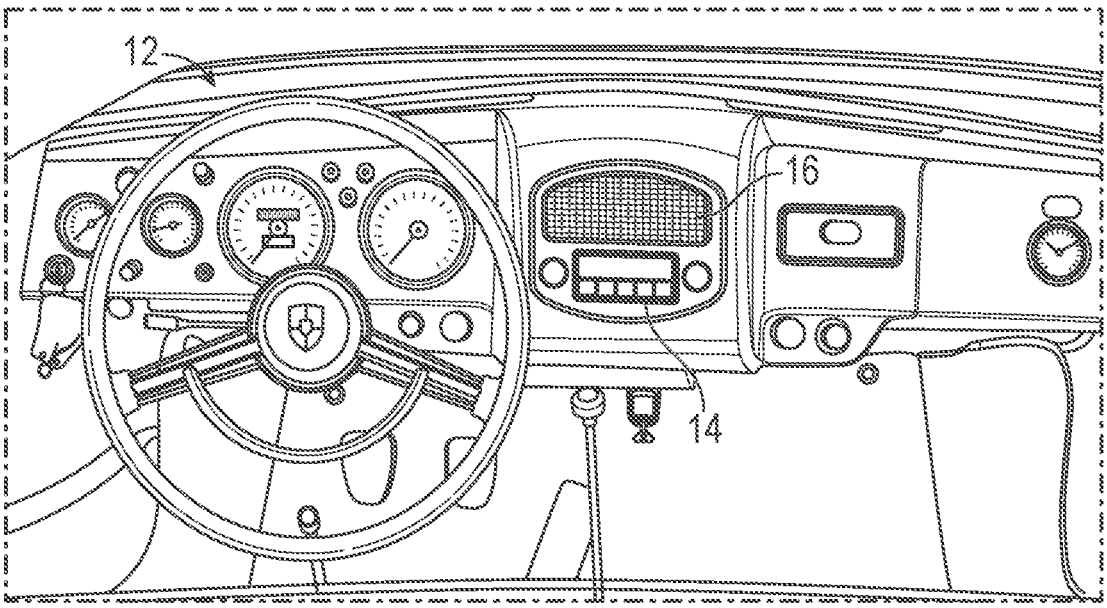
Fig. 1B (Prior Art)
FIG. 1B illustrates the dashboard of the automobile of FIG. 1A, showing the configuration and placement of the legacy radio.

An exemplary vintage automobile 10 is shown in FIG. 1A. Such automobiles are highly prized by collectors. FIG. 1B illustrates the dashboard 12 of the automobile of FIG. 1A, with the legacy car radio depicted at 14.

Depending on the model year of the automobile, the radio may receive analog AM only, analog AM and FM, or in some instances analog AM, FM and another band such as analog HF (shortwave) or analog VHF weather band. Typically such analog radios are based on regenerative or superhetrodyne receiver technology to provide reception and tuning of the analog stations, coupled with a detector to extract audio signals from the analog radio frequency carrier, which audio signals are then supplied to an audio amplifier coupled to a speaker. The speaker is typically mounted in the dashboard, as illustrated at 16 in FIG. 1B.

In legacy car radios, the electronic components typically comprise discrete resistors, inductors, transformers and capacitors, as well as discrete active devices such as bipolar transistors, or vacuum tubes or valves. Where vacuum tubes are used, an additional vibrator device is often used to convert the DC current from the car battery into AC current that can be stepped up using transformers to supply the high voltages required for the tubes.

Figure 2A:
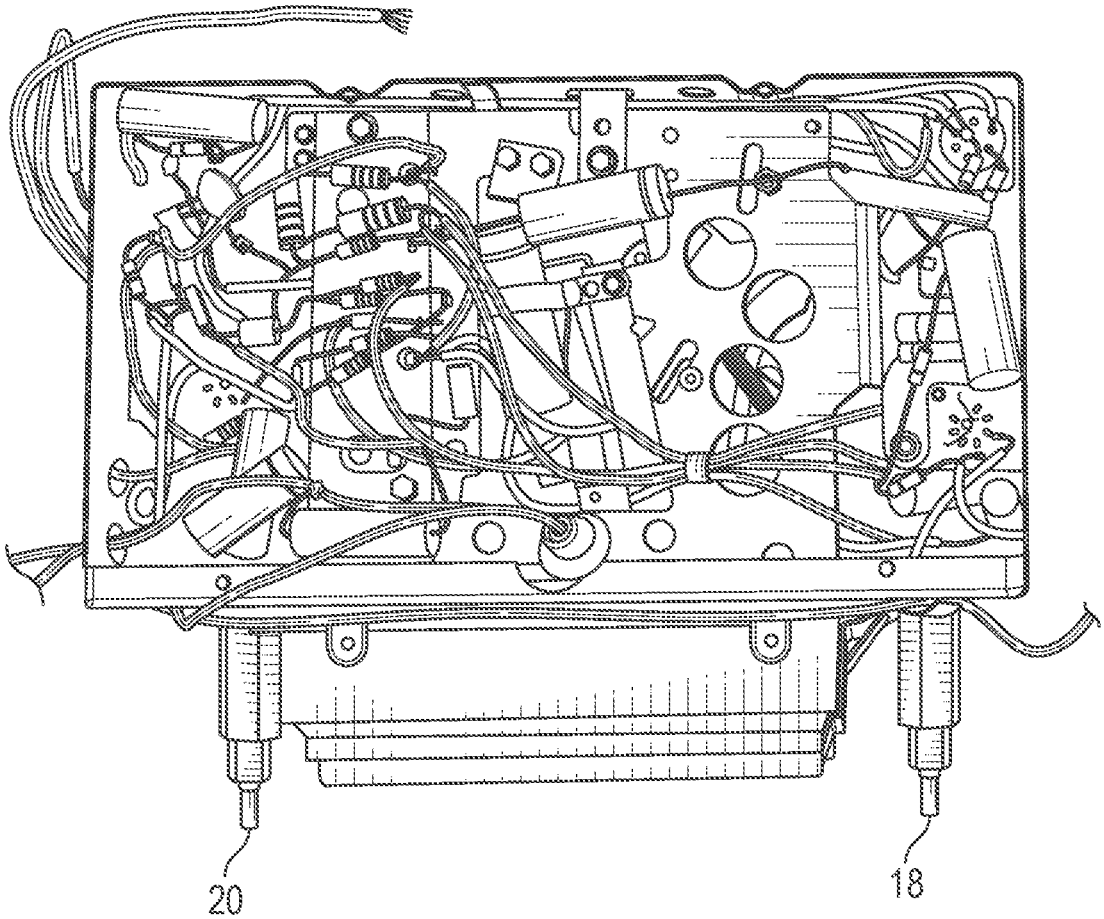
Fig. 2A (Prior Art)
FIG. 2A is a plan view of the chassis of an exemplary legacy radio, showing nature of legacy radio components.

To illustrate, FIG. 2A shows the chassis compartments of an exemplary legacy car radio. Note that these compartments are filled with electronic components. In FIG. 2A, the volume control shaft 18 and tuning control shaft 20 are seen. Some radios may also include additional concentric knobs, for adjusting the audio tone, or for adjusting the speaker balance in radios that have stereo capability.

Figure 2B:
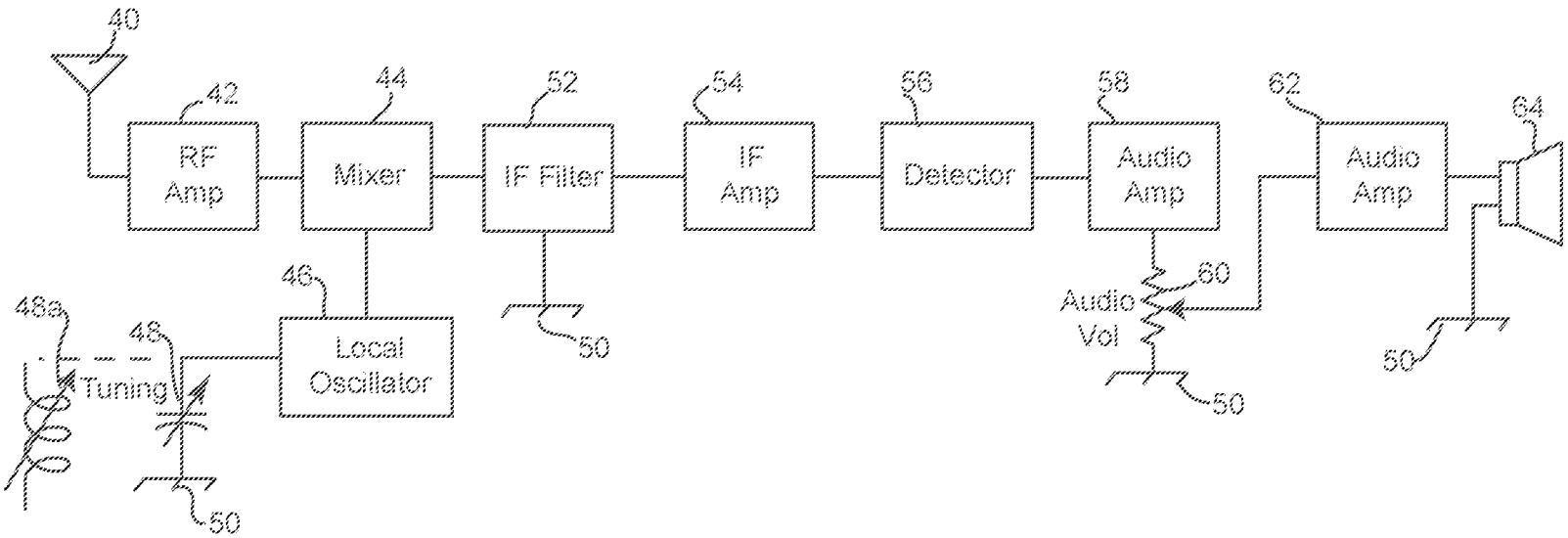
Fig. 2B (Prior Art)
FIG. 2B is a schematic diagram of an exemplary RF-tuned legacy radio.

It is important to understand that such a legacy radio is designed to tune different radio frequencies, to detect or demodulate the audio program material carried by a tuned radio frequency and then to amplify the audio program material so it can be played through a loudspeaker. FIG. 2B shows, in somewhat simplified form, how the circuitry of a legacy radio is engineered. The analog radio broadcast, comprising an RF carrier that has been modulated with the audio program material, is received by the antenna 40. The received signal is then fed through an RF amplifier 42 to the mixer 44. The mixer combines the amplified RF signal with the signal from a local oscillator 46 and such mixing produces sum and difference components, which result when the received RF signal and the local oscillator waveforms are multiplied together.

The purpose of the mixer is to produce a lower frequency version of the received RF signal. The actual frequency produced by the local oscillator 46 is tuned by either a variable tuning capacitor 48 or a variable inductor 48*a*, which in the exemplary circuit is referenced to chassis ground 50. This variable tuning capacitor 48 (or variable inductor 48*a*, depending on which is used) is controlled by the tuning shaft 20 of the tuning mechanism (capacitor 48 or inductor 48*a*). The output of the mixer 44 is then fed to the IF filter 52, which is designed to pass a narrow band of frequencies centered at a predetermined fixed IF frequency and reject all other frequencies outside that band. In this way, only the sum or the difference component is allowed to pass. If the lower frequency is selected, the radio is called a down-conversion radio; if the higher frequency is selected, the radio is called an up-conversion radio. In either case, by tuning the local oscillator using the radio's tuning knob 24, the user is, in effect, selecting a particular radio frequency to listen to.

The output of the IF filter 52 is then boosted by IF amplifier 54 and a detector 56 strips away the RF carrier and passes the audio program material to a first audio amplifier stage 58. This audio stage is coupled through the audio volume control potentiometer 60 and then fed to a second audio amplifier stage which then drives speaker 64.

As we shall see, the electronic circuit of the present disclosure processes an incoming digital audio broadcast through a much different process that differentiates different radio stations by their respective digital identifiers, rather than on the basis of tuned frequency. Thus the electronic circuit of the present disclosure must utilize a new way for the user to "tune" different stations using the legacy controls.

Interfacing to Legacy Controls and the Tuning Dial

Figure 3:
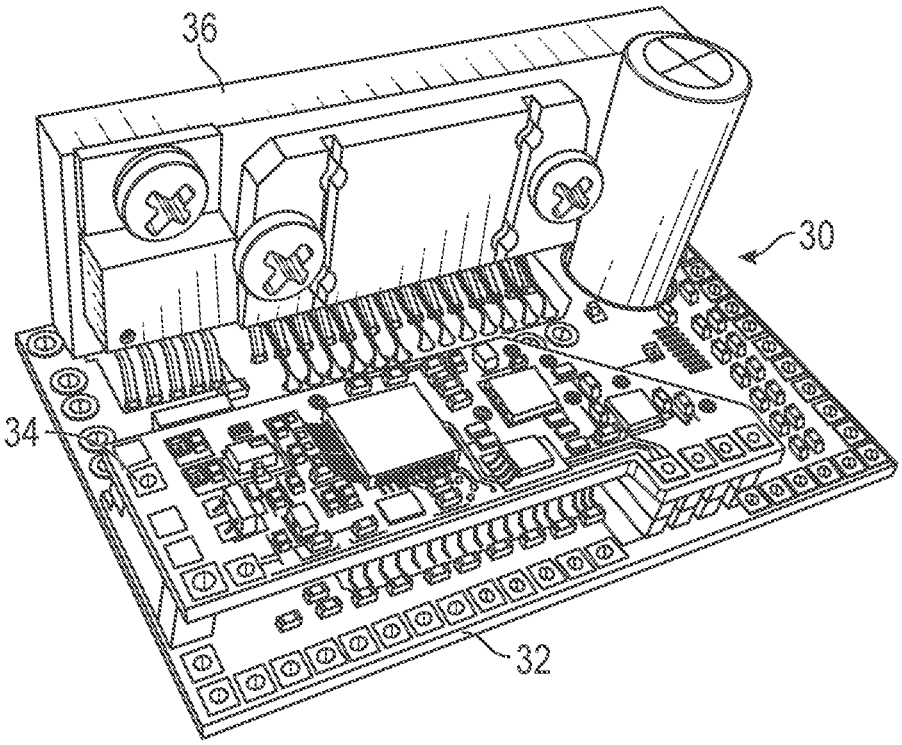
FIG. 3 is a perspective view of one embodiment of the electronic conversion circuit.
Figure 4:
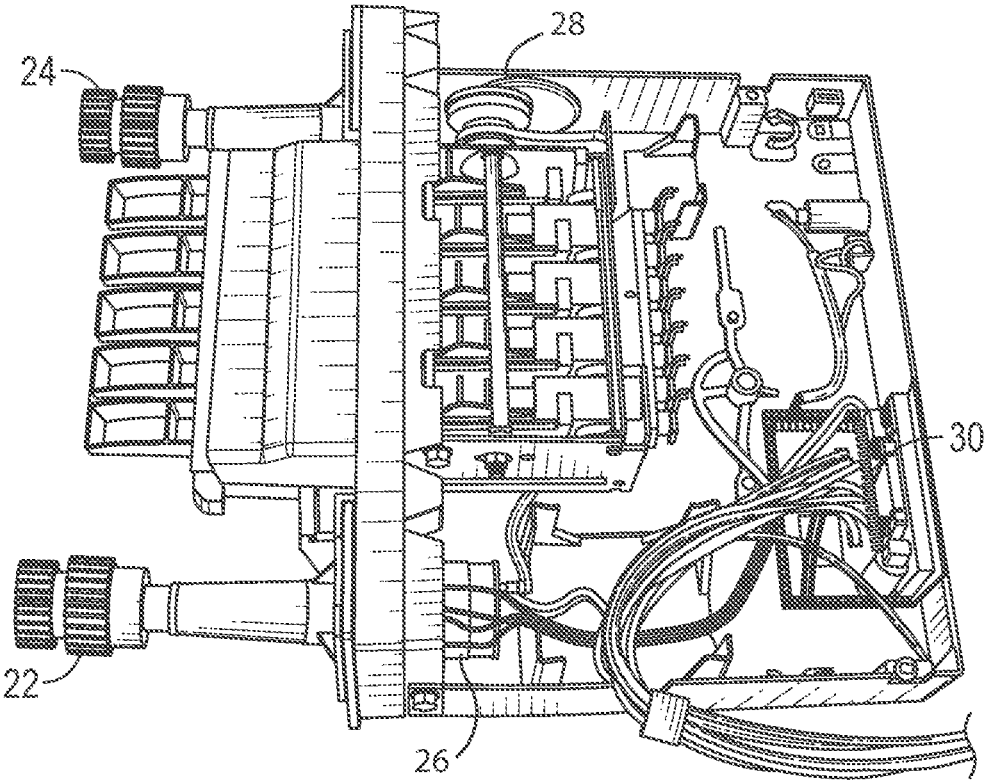
FIG. 4 is a top perspective view of the chassis of an exemplary legacy radio, with legacy components removed and the disclosed electronic conversion circuit installed.

The electronic conversion circuit of the present disclosure, an embodiment being illustrated in FIG. 3, can be implemented on a circuit board that is small enough to fit inside the chassis of a legacy radio even without removing the legacy components. However, in many cases, the legacy radio may no longer be functioning, thus the electronic components of the legacy radio may be removed, except for the volume control and tuning mechanism. This has been illustrated in FIG. 4, where the legacy volume control component 26 (e.g., resistive component or potentiometer) and the tuning mechanism 28 remain in place while the other legacy components have been removed. FIG. 4 illustrates the electronic conversion circuit of the present invention at 30.

As can be seen from FIG. 3, the electronic circuit 30 may comprise first or primary circuit board 32 carrying the basic radio and audio amplifier components, and a second or daughter board 34 carrying the digital audio broadcast (DAB) specific components. As illustrated, secured to the first circuit board is an upstanding heatsink 36 to which the audio power transistors are coupled for heat dissipation. In some embodiments, the electronic circuit 30 may be equipped with analog AM and FM receivers, and optionally also with FM-HD receivers to replace the analog radio circuitry altogether. These analog AM and FM receivers may be carried on the first circuit board 32 and are thus provided in addition to the DAB specific components carried on the daughter board 34.

In most legacy radio circuit designs, the volume control component 26 was typically a resistive component (e.g. potentiometer, or ganged pair of potentiometers) that were connected in the audio amplifier circuit to change the audio gain prior to the final amplifier stage. The tuning mechanism was typically a geared mechanism to gradually adjust the position of a ferrite tuning slug within a tuning inductor or to gradually adjust the angular position of a variable capacitor in one of the RF stages. To give a visual indication of the channel being tuned, it was common to connect a string between pulleys coupled to the tuning mechanism. An indicator needle was attached to the string, so that when the angular position of the inductor or capacitor was moved, the tuning needle would laterally move to indicate the frequency as printed on a glass faceplate of the radio.

Figure 5:
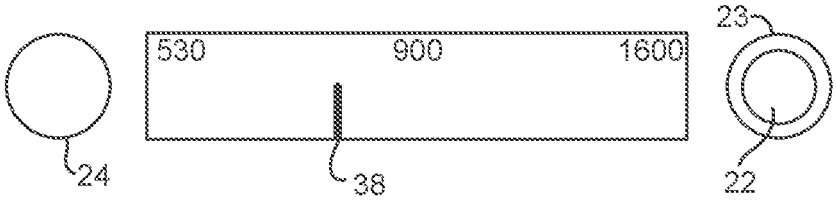
Fig. 5 (Prior Art)
FIG. 5 is a front view of the tuning dial display of a legacy radio.

FIG. 5 shows an exemplary tuning faceplate of a legacy radio with the tuning needle 38 positioned between approximately one-third up from the lower end of the analog AM broadcast band. FIG. 5 also shows the volume knob 22, concentric tone control knob 23 and tuning knob 24. As the tuning knob 24 is rotated clockwise, the radio receiver is tuned higher in the band (the tuning needle moves to the right). Conversely, as the tuning knob 24 is rotated counterclockwise, the radio receiver is tuned lower in the band (the tuning needle moves to the left). Note that legacy radios did not have any digital readouts capable of displaying information generated by microprocessors.

As will be more fully described below, the electronic conversion circuit 30 of the present disclosure repurposes the volume control to provide an angular position signal that is processed by a microprocessor of the electronic circuit. Additionally, the electronic conversion circuit 30 repurposes the tuning mechanism to provide an angular position signal that is likewise processed by the microprocessor of the electronic circuit. Repurposing of the tuning mechanism, however, does not change its original function of moving the tuning needle as the tuning knob is turned. As will be more fully explained, the electronic conversion circuit 30 identifies all stations in a DAB data stream and allocates individual stations to different places across the analog tuning band, as if those DAB stations were actually transmitting on different RF frequencies in the analog AM or FM band.

The Digital Audio Broadcast (DAB) Data Stream

Figure 6:
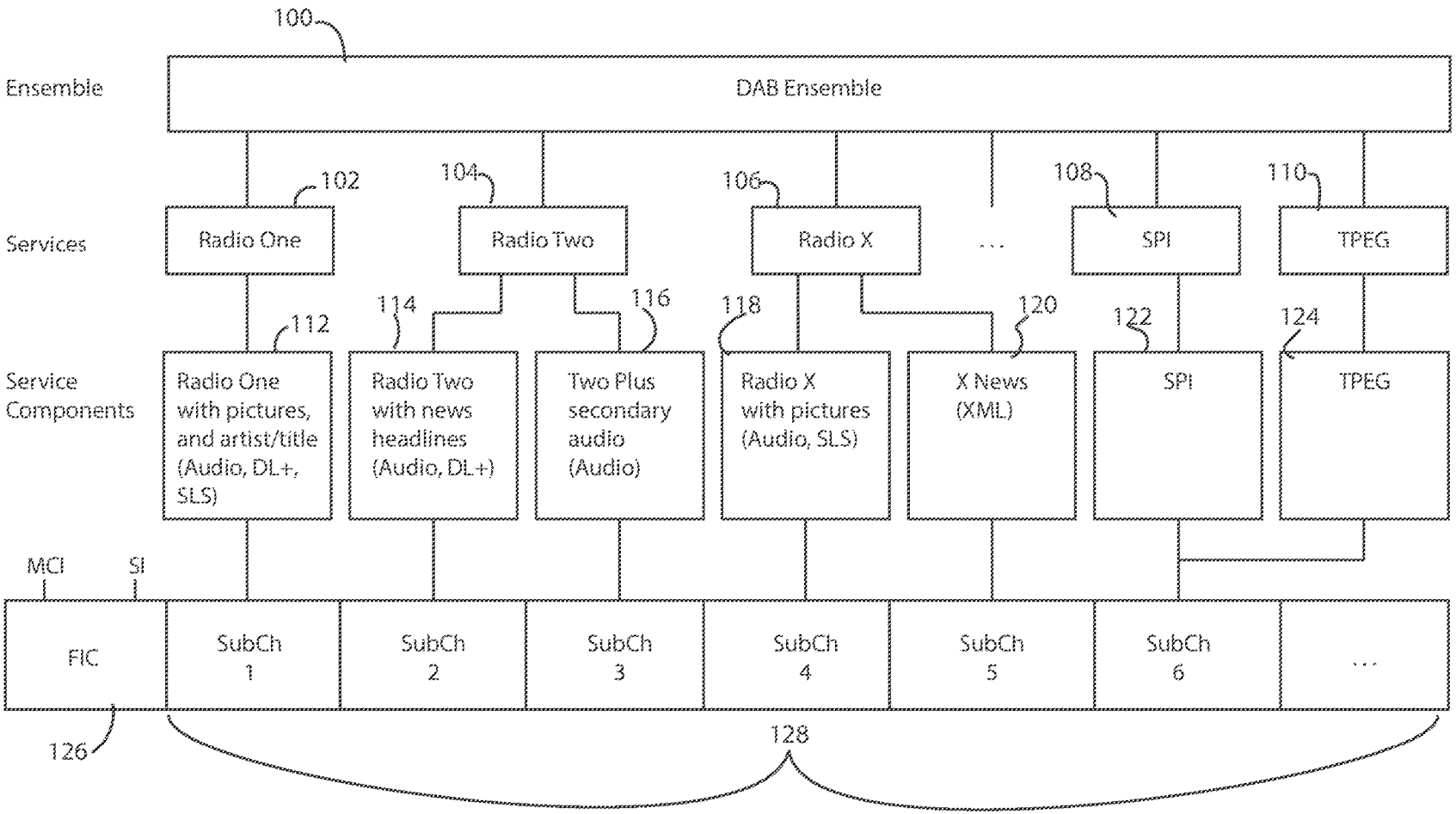
Fig. 6 Prior Art
FIG. 6 is a diagram explaining the DAB data stream.

The DAB radio stations can perhaps best be understood by referring to the DAB data stream, illustrated in FIG. 6. In contrast with analog AM and FM radio, the DAB protocol is designed to allow multiple different radio stations to broadcast simultaneously on the same radio frequency. Indeed, the protocol is designed to allow multiple different radio stations to share the same transmitter. Thus, multiple different radio stations share the cost of a single transmission.

The DAB protocol works by allocating multiple stations to what the DAB protocol terms an "ensemble." As defined in the Draft ETSI EN 300 401 V2.1.1 (2016-10) specification, each DAB ensemble has a total capacity to supportjust over 2.4 Mbits per second in a system bandwidth of 1.5 Mhz. Depending on the requirements of a broadcaster (transmitter coverage and reception quality being some of the deciding factors) the amount of error correction is adjustable for each service independently. Thus the available bit rate for broadcast services will typically range between 0.6-1.7 Mbits per second. This total capacity may be allocated to a plurality of different radio stations, each station broadcasting its own unique program material simultaneously. The DAB protocol supports audio, video and data broadcasts.

FIG. 6 shows how the DAB ensemble 100, made up of a plurality of subchannels 128 with an appended fast information channel (FIC) 126, may be shared by a plurality of different broadcast networks, each providing unique services. Each of these different broadcast networks can be allocated different amounts of capacity (different allocated bits per second). By way of example, FIG. 6 shows a first exemplary service 102, labeled Radio One, which represents a typical program service with only one primary service component 112. As illustrated this primary service component 112 carries audio, and additional program associated data (PAD) containing a slide show of pictures with artist and title tag information added. The audio portion comprises digitally encoded audio data, while the artist and title tag information comprises dynamically labeled text (DL+).

The second exemplary service 104, labeled Radio Two, comprises two service components 114 and 116. The first service component 114 carries news programs plus additional headline text. The second service component, labeled Two Plus, carries additional audio content.

Third exemplary service 106, labeled Radio X, comprises two service components 118 and 120. The former component 118 contains audio and a slide show. The later component 120 contains and XML-based information service.

The fourth service 108, labeled SPI, consists of only a primary service component 122 carrying service and program information (SPI) for the whole ensemble 100.

The fifth service, labeled TPEG, consists of only a primary service component 124 carrying traffic and travel information (TTI) using the Transport Protocol Expert Group (TPEG) format. This traffic and travel information provides useful information for motorists. Note that the SPT component 122 and the TPEG component 124 share the same sub-channel (SubCh 6).

The organization of the sub-channels, services and service components in an ensemble is managed by the multiplex configuration information (MCI) contained within the fast information channel (FIC) 126 appended to the beginning of the ensemble 100. The management configuration information serves five principal functions:

1. To define the organization of the sub-channels in terms of their position and size in the common interleaved frame (CIF) and their error protection;
2. To list the services available in the ensemble;
3. To establish the links between service and service components;
4. To establish the links between service components and sub-channels; and
5. To signal a multiplex reconfiguration.

Further details of the DAB protocol and the organization of the ensemble data structure can be found in reference documents, such as ETSI EN 300 401 V2.1.1 (2016-10), available on the ETSI Web server (https://ipr.etsi.org/).

The Electronic Conversion Circuit

Figure 7:
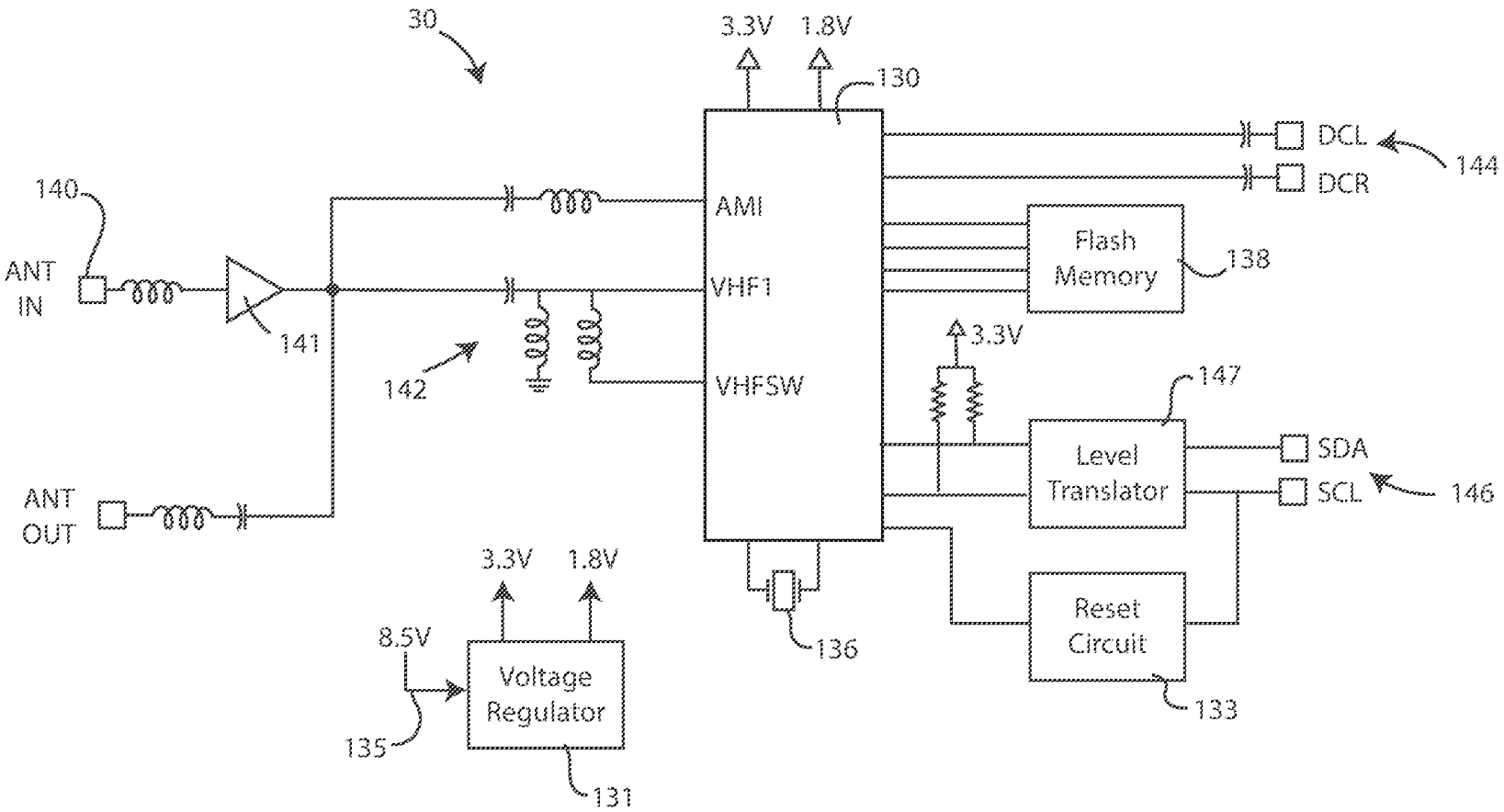
FIG. 7 is an electronic circuit diagram showing DAB receiver components of the electronic conversion circuit.
Figure 8:
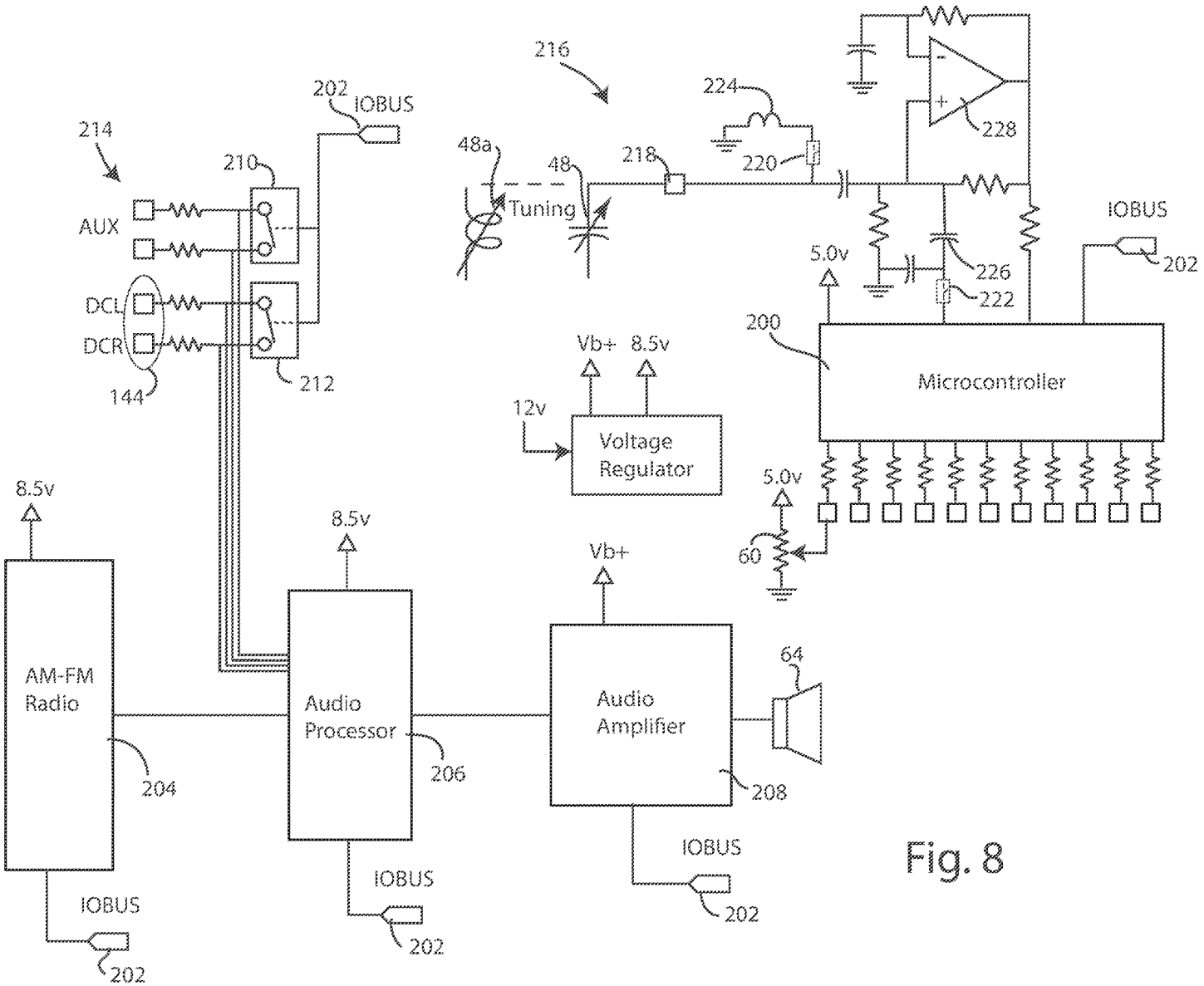
FIG. 8 is an electronic circuit diagram showing additional components of the electronic conversion circuit, including components used to interpret legacy tuning movements and to convert those into DAB control signals.

The electronic conversion circuit 30 of the present disclosure is shown more fully in the schematic diagrams of FIGS. 7 and 8. In the disclosed embodiment the electronic circuit 30 has been implemented with some components disposed on a first circuit board, such as the primary circuit board 32 of FIG. 3, with the remaining components disposed on a second circuit board, such as the daughter board 34 of FIG. 3. Other configurations are of course possible. If desired, all components can be deployed on a single circuit board, for example. In the present disclosure, the components on the daughter board 34 (FIG. 3) are shown in the schematic diagram of FIG. 7 and the components on the primary circuit board 32 are shown in the schematic diagram of FIG. 8.

Referring to FIG. 7, the electronic conversion circuit 30 includes a single-chip, AM/FM/HD/DAB/DAB+ radio receiver circuit 130. This radio receiver circuit may be implemented using an integrated receiver circuit chip, such as the Si4689-A10 integrated circuit available from Silicon Laboratories, for example. The radio receiver circuit 130 and other associated components are powered by direct current supplied by a power supply 131 comprising a 3.3 volt regulator and a 1.8 volt regulator. The power supply 131 itself is powered from an 8.5 volt DC power source 135 that is derived from the vehicle battery, using a voltage regulator located on the primary circuit board 32. See FIG. 8 for details. The radio receiver circuit 130 employs an internal clock generator that is crystal controlled. For this purpose, a 19.200 MHz crystal 136 is coupled to the receiver circuit's XTALI (XI) and XTAKO (XO) terminals. The radio receiver circuit 130 is also designed to utilize external flash memory 138, which may be implemented using a serial interface flash memory device, such as the AT25SF041-SSHD available from Adesto Technologies, for example.

The antenna to supply RF input to the radio receiver circuit 130 is coupled at antenna port 140. The received incoming RF signal is inductively coupled to a monolithic microwave integrated circuit (MMIC) amplifying stage 141 and then coupled through an LC matching network 142 which distributes the amplified RF signal to the RF input port (VHFI) of the radio receiver circuit 130. The radio receiver circuit is able, through its VHFSW switching port, to select which inductors are included in the LC matching network 142, to selectively provide a better match when receiving FM broadcasts, as opposed to DAB broadcasts. The LC matching network 142 also delivers a signal to the AMI port to allow the radio receiver circuit to also receive AM broadcasts.

The radio receiver circuit 130 supplies a stereo audio output at 144. In the case of a legacy radio that has only a single monaural speaker, these stereo signals may be combined to produce a monaural output. In the illustrated primary board—daughter board implementation, the audio output 144 will be coupled to input terminals within the audio amplifier portion of the AM-FM circuitry carried on the primary board. The amplifier portion of that circuit drives the speaker or speakers located in the vehicle, as will be described below.

Inside the radio receiver circuit 130, the input RF signal (on VHFI input port) is passed through a low noise amplifier and then down-converted by mixing with the crystal controlled internal clock generator acting as a local oscillator that can be tuned in frequency by control circuitry within the receiver circuit. The down-converted signal is then digitized using an onboard analog-to-digital convertor (ADC) and these data are supplied to an onboard digital signal processing (DSP) circuit.

In order to select a particular broadcast, i.e., a particular DAB service component, the user sends commands to the radio receiver circuit 130 to access the data associated with the desired DAB service component—which is contained within a particular sub channel, as was illustrated in FIG. 6. Selection commands are physically input by turning knobs on the legacy radio to produce knob position command signals that are interpreted by the microcontroller on the primary circuit board, as will be described below. These command signals are from the primary circuit board then supplied to the daughter board on the SData (SDA) and SClock (SCL) terminals 146. These signals are processed by a suitable voltage level translation integrated circuit 147. As illustrated, a reset circuit 133 fed by the SClock terminal provides reset commands to the radio receiver circuit 130.

In order to keep the legacy radio as close to the original user interface as possible, the electronic circuit 30 uses existing volume, tone and tuning controls to receive user input—through turning the controls clockwise or counter-clockwise in different patterns to represent different control functions. The electronic circuit 30 translates these clockwise and counter-clockwise turning movements by placing a reference voltage, such as 5 volts across the potentiometers of the volume and tone controls, so that these potentiometers produce a voltage signal indicative of knob position. These knob position signals are translated to commands that are sent to the radio receiver.

FIG. 8 illustrates the microcontroller component and the AM-FM circuitry carried on the primary circuit board 32. Included is a microcontroller 200 that communicates over an IOBUS 202 with other circuit components, including the AM-FM radio circuit 204, an audio processor circuit 206 and an audio amplifier circuit 208. In one embodiment the microcontroller 200 may be implemented using an ATMega328PB-AU integrated circuit, or the like. The AM-FM radio circuit 204 may be implemented using a TEF6606T/VS integrated circuit, or the like; the audio processor circuit 206 may be implemented using a TDA7718N integrated circuit and the audio amplifier circuit 208 may be implemented using a TDA7569BLV, or the like.

As illustrated the IOBUS supplies data pins DCL and DCR 144 which are carried to the daughter board 34 (FIG. 7) to carry left and right channel digital audio signals from the DAB radio receiver circuit 130 on daughter board 34 to the audio processor circuit 206. Processor controlled switches 210 and 212 are used to combine a stereo signal to mono before being fed to the audio processor.

The primary circuit board 32 also carries a voltage regulator circuit 216 that takes the nominal 12 volts from the vehicle electrical system, which normally includes a 12 volt battery, and provides various DC supply voltages needed for different components on the primary and daughter boards. In the illustrated embodiment, regulated 8.5 volts and 5.0 volts are provided, along with a regulated supply voltage Vb+ at nominally the vehicle supply voltage. As illustrated in FIG. 8, the Vb+ supply provides power to the audio amplifier 208. The 5.0 volt supply powers the microcontroller 200 and the 8.5 volt supply powers the AM-FM radio circuit 204, the audio processor circuit 206, and is also fed to the daughter board at designated at 135 in FIG. 7.

Converting Legacy Tuning Control Positions into Digital Data Signals

The circuitry for converting rotational position of legacy tuning controls into digital data signals is shown generally at 216. As discussed above, for channel tuning some legacy radios use a variable tuning capacitor 48, while others us a variable inductor 48*a*. In this context, the tuning capacitor 48 and variable inductor 48*a* both constitute reactive tuning components. Thus, both have been illustrated in FIG. 8 and it will be understood that in an actual legacy radio only one or the other would be used for channel tuning. The rotational position conversion circuitry 216 is able to accept either variable capacitor 48 or variable inductor 48*a*, simply by attaching the device at terminal 218. A variable capacitor 48 is shown attached in FIG. 8. Depending on what type of device (capacitor or inductor) is attached at terminal 218, the microcontroller 200 configures certain components to define a resonant LC network. As explained below, the microcontroller 200 defines a resonant LC network by coupling a complementary reactive component to the reactive tuning component of the legacy tuning control.

The microcontroller 200 does this by selectively opening and closing electronically controlled switches 220 and 222. When tuning capacitor 48 is attached at terminal 218, the microcontroller closes switch 220 and opens switch 222. In so doing, inductor 224 is switched into the circuit, forming a resonant LC circuit with tuning capacitor 48. Alternatively, when tuning inductor 48*a* is attached at terminal 218, the microcontroller opens switch 220 and closes switch 222. In so doing, capacitor 226 is switched into the circuit, forming a resonant LC circuit with tuning inductor 48*a*. If desired the microcontroller can automatically determine whether and inductor or a capacitor has been attached at terminal 218 by selectively first switching in the inductor 224 and then the capacitor 226, testing in both instances whether a resonant LC circuit is detected.

In both cases, the resonant LC circuit so formed is coupled to an oscillator circuit defined by comparator circuit 228. As the variable component (capacitor 48 or inductor 48*a*) changes, the LC resonant frequency and thus the oscillator frequency changes, producing a series of pulses at the oscillator frequency, which are counted over a predetermined time interval by microcontroller 200. In this way, the microcontroller obtains a count value that is indicative of the angular or rotational position of the legacy tuning knob.

Position of the legacy volume control knob is handled differently in the illustrated embodiment. In most cases, legacy radios use a potentiometer attached to the volume knob 22. This was illustrated by potentiometer 60 in FIG. 3. Thus, to obtain an indication of the angular or rotational position of the legacy volume knob, potentiometer 60 may be coupled to one of the analog inputs of microcontroller 200. Within the microcontroller is an analog to digital converter that converts the voltage applied to an analog input into a digital data value. In this way, the microcontroller obtains a digital value indicative of the angular or rotational position of the legacy volume knob. This same technique for acquiring angular or rotational position of the legacy volume knob via a potentiometer can also be used to acquire angular or rotational position of the legacy tuning knob—in cases where the original inductor or capacitor of the tuning circuit has been damaged or is missing. In such case a potentiometer can be physically connected to the tuning knob shaft that once coupled to the inductor or capacitor.

The digital signals indicative of the respective legacy tuning control and volume control knob positions is actually an instantaneous value that will change as the corresponding knob is rotated clockwise or counter-clockwise. The microcontroller is programmed to capture and store these instantaneous values in a circular buffer designed to store a predetermined number of the most recently captured tuning knob and volume knob positions. By processing the data in these buffers, the microcontroller detects when each knob begins to move and in what clockwise or counter-clockwise direction. Instantaneous positions that increase over time indicate movement in a first rotational direction, while positions that decrease over time indicate movement in the opposite rotational direction.

In addition to using the legacy tuning knob 24 and volume control knob 22, other knobs can be used as well. This includes the legacy radio tone control knob 23, which is sometimes located concentrically adjacent the volume knob, as illustrated in FIG. 5. On more advanced legacy radios, other rotational knobs may also be used, such as front-back surround sound fader knobs and left-right stereo balance knobs. Furthermore, some legacy radios also mechanical pushbuttons that produce physical motion of the tuning dial, thus causing the dial to rotate to a predetermined frequency as set by the user. These pushbuttons exhibit linear in-out movement, (pushbutton actions) that can also be repurposed using suitable microswitches to supply control instructions that can be interpreted by the microcontroller.

Interpreting Positional Settings and Knob Movement as Control Commands

Figure 10:
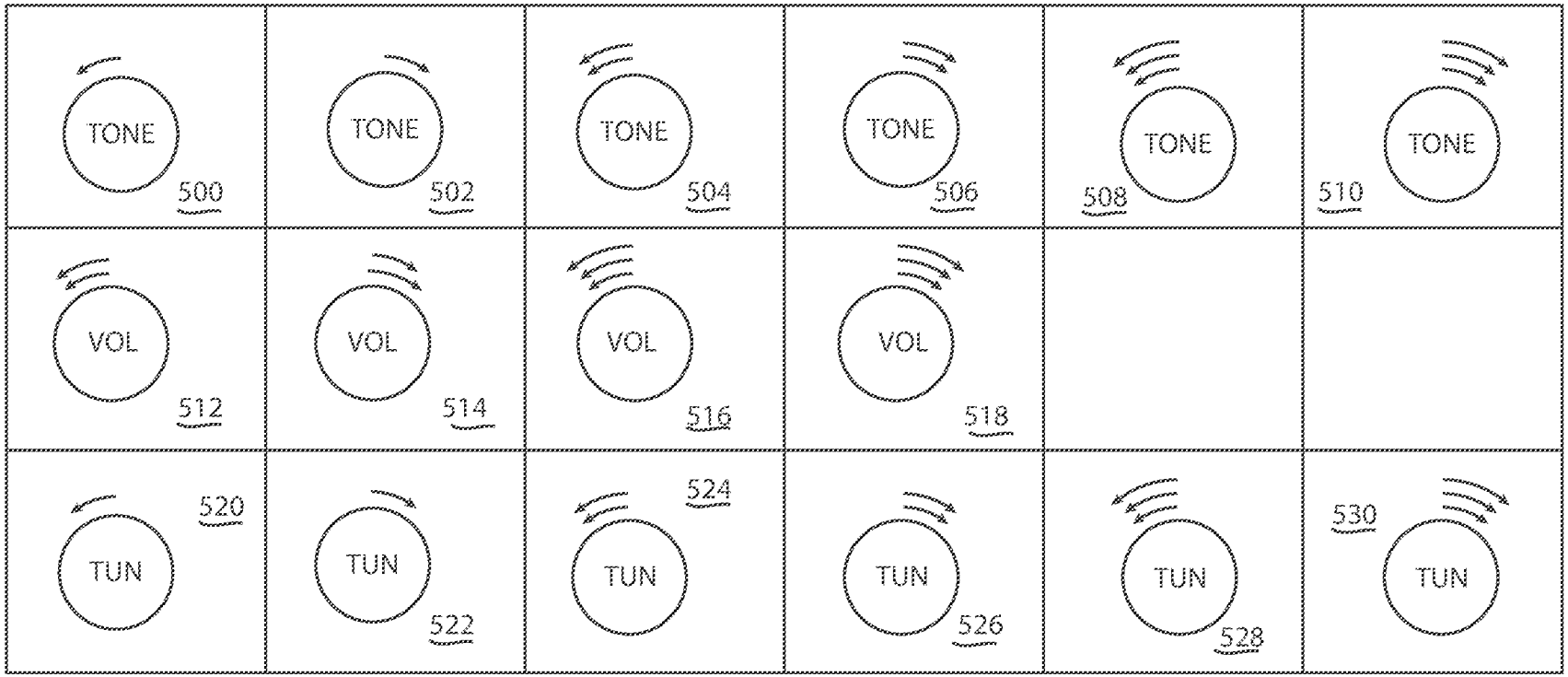
FIG. 10 is a chart showing how different bidirectional movements and pushbutton movements of a legacy radio control are mapped onto DAB control functions by the electronic conversion circuit.

Using this movement information in combination with the current instantaneous position of the respective knobs, the microcontroller is programmed to detect different patterns of rotational movement and these are associated with different meta-commands that are used to give the radio user supervisory control over various advanced functions found in DAB radios and also over various advanced functions that are unique to the disclosed electronic circuit. For example, as illustrated in FIG. 10, the microcontroller may be programmed to interpret different rotational movement patterns as corresponding to different meta-commands. These different rotational movement patterns comprise the different classes of movement including mono-directional movements (clockwise or counter-clockwise that end in a different position than when started) and bidirectional movements (back and forth movements, also called twisting movements, that end in substantially the same position as when started). Bidirectional movements can be concatenated to define double bidirectional movements (double twists) and triple bidirectional movements (triple twists), and combinations of mono-directional and bidirectional movements.

Figure 11:
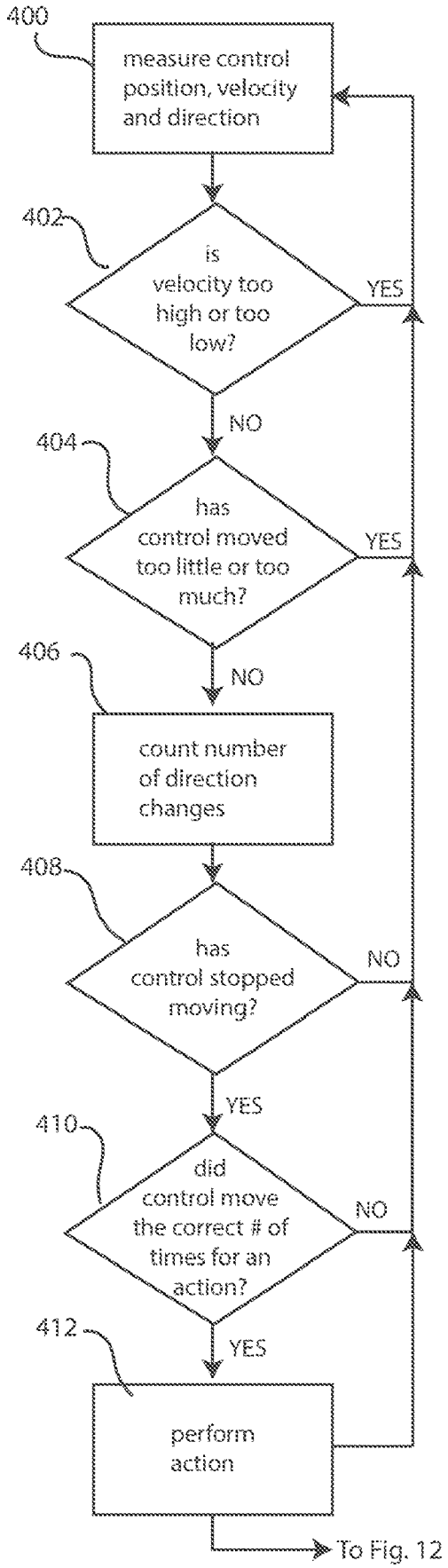
FIG. 11 is a flowchart depicting the control processing loop operated by the microcontroller to decode movement commands of the legacy control knobs.

FIG. 11 illustrates how the microcontroller 200 (FIG. 8) is programmed to decode the movement commands entered by a user via the legacy volume, tone and tune control knobs. Specifically, FIG. 11 illustrates the control processing loop that is shared by all legacy controls (e.g., volume, tone and tune). Beginning at step 400, the microcontroller 200 receives a signal from a legacy control, such as the volume, tone, or tune knobs. These signals are converted into digital data values by the analog to digital converters within the microcontroller circuit. When the legacy control knob is stationary, the digital data value represents a positional setting of the control device. The microcontroller 200 polls this digital data value at a predefined sampling rate and in this way the microcontroller can track the value as it changes when the control is manipulated by the user. Using the digital data values captured as the control position changes, the microcontroller calculates the change in the digital value over a predetermined time interval (velocity) and also the direction of rotation (whether the digital value is increasing or decreasing). These calculations can be seen as producing vector velocity information (rotational speed and direction) that is used in decoding the user command.

In step 402, the microcontroller 200 compares the absolute velocity (i.e., the absolute value of the vector velocity) to predetermined upper and lower thresholds. If the absolute velocity is above or below these thresholds, the values are ignored and control branches back to step 400. This is done to filter out or ignore inadvertent rotational movements of a control device, such as if the user accidentally bumps a knob, producing a fast change, or if the position of a knob incrementally drifts due to road vibration.

Next in step 404, the microcontroller 200 tests by comparing the distance traveled during a rotational motion against predetermined upper and lower thresholds. If the control device has moved too little or too much, the movement is ignored and control branches back to step 400.

Assuming the movements have not been discarded by steps 402 and 404, the microcontroller at step 406, counts the number of direction changes. The microcontroller does this by observing in the captured digital data each time the rotational direction changes (i.e., each time the vector velocity changes direction). This count number is stored by the microcontroller and used in subsequent steps.

Next, in step 408, the microcontroller determines if control movement has stopped. If not, control branches back to step 400 where further movement data can be captured as discussed above. However, if motion of the control has stopped, control branches to step 410 which tests whether the number of direction changes have occurred to constitute a valid command. As illustrated in FIG. 10, an embodiment may consider single, double and triple twists of a control knob to be a valid command. If a user were to have issued a quadruple twist, the microcontroller 200 interprets this as an error at step 410, whereupon the errant command is ignored and control branches back to step 400.

Figure 12:
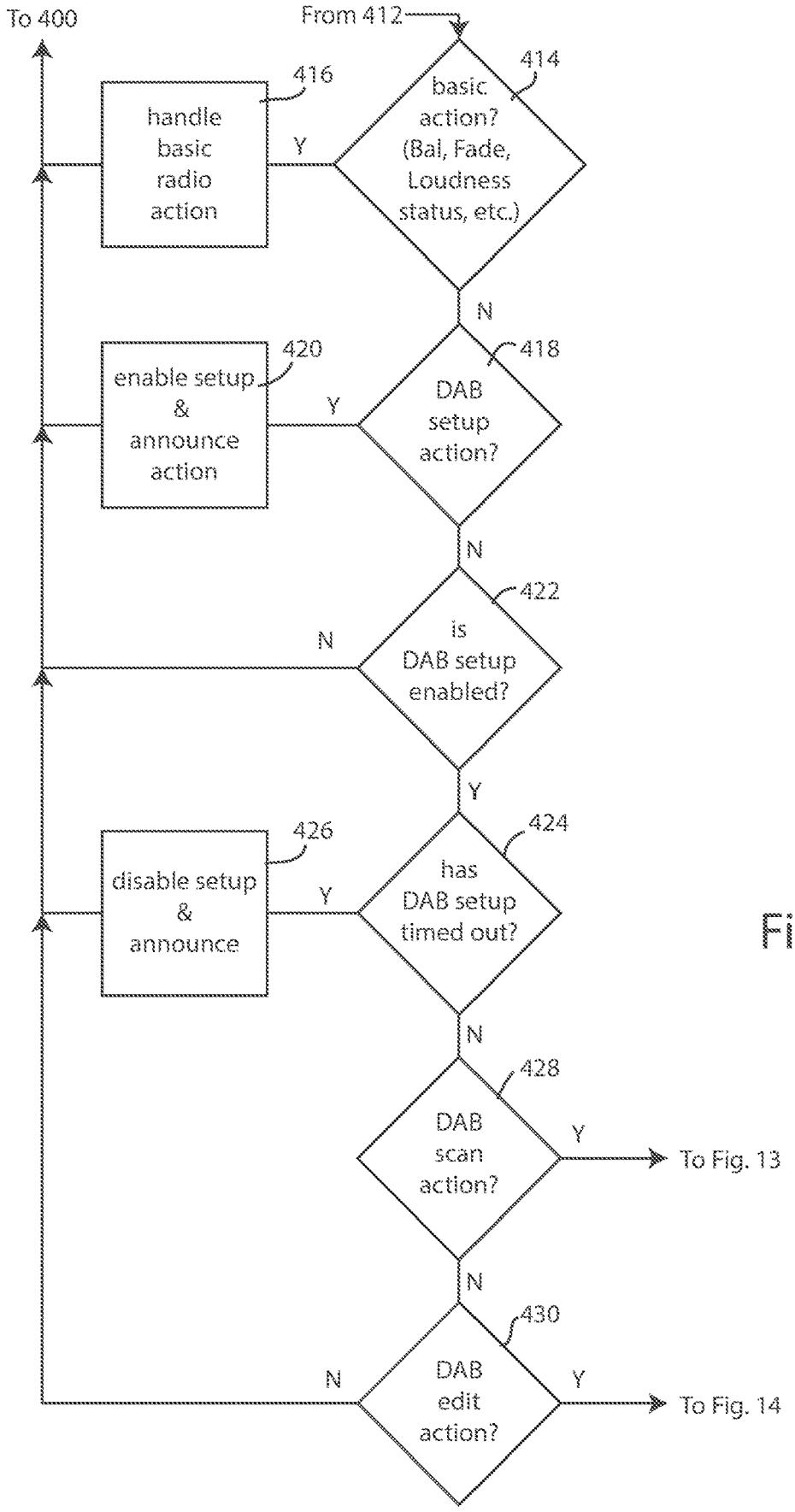
FIG. 12 is a flowchart depicting the process performed by the microcontroller in performing actions commanded by the user in manipulating the legacy control knobs.

If the control command is deemed valid at step 410, control branches to step 412 where the microcontroller performs the command. The details of step 412 are shown in FIG. 12. Examples of such commands include a command to cause the radio receiver circuit 130 to execute a scan operation that tunes the radio to the RF frequency of a digital radio broadcast station and queries the received DAB data stream to compile a channel list of all detected digital stations sending DAB data on that RF frequency.

Referring to now to FIG. 12, the microcontroller 200 tests at step 414 if the control knob manipulation was one of the basic actions (e.g., adjusting balance and fader, adjusting loudness, etc.) for which no supervisory DAB control is required. If this is the case, the Microcontroller 200, at 416, simply handles the basic radio action (i.e., the radio performs the requested non-metacommand function, such as adjusting balance, fader and loudness, or tuning DAB channels as selected via the tuning knob. Control then proceeds to step 400 in FIG. 11.

If the control knob manipulation is decoded by the microcontroller 200 as representing a command for DAB Setup, at 418, the microcontroller at 420 enables or initiates the Setup mode and annunciates that state to the user via verbalized audible announcement. Control then proceeds to step 400 in FIG. 11.

If the control knob manipulation was not decoded as a command for DAB Setup, the microcontroller tests at step 422 whether the Setup mode has already been enabled. If not, control then proceeds to step 400 in FIG. 11. Otherwise, the microcontroller at step 424 tests whether the DAB setup mode has timed out. In one embodiment the DAB setup mode times out after 8 seconds. In the event of such a time out, control branches to step 426, where the microcontroller disables the Setup mode, announces that the mode has been disabled and then passes control to step 400 in FIG. 11.

If at step 424 the DAB setup has not timed out, control proceeds to step 428 where the microcontroller tests whether the user has input a DAB scan action, or a DAB edit action at 430. If the DAB scan action was selected, control branches to FIG. 13. If the DAB edit action was selected, control branches to FIG. 14.

Figure 13:
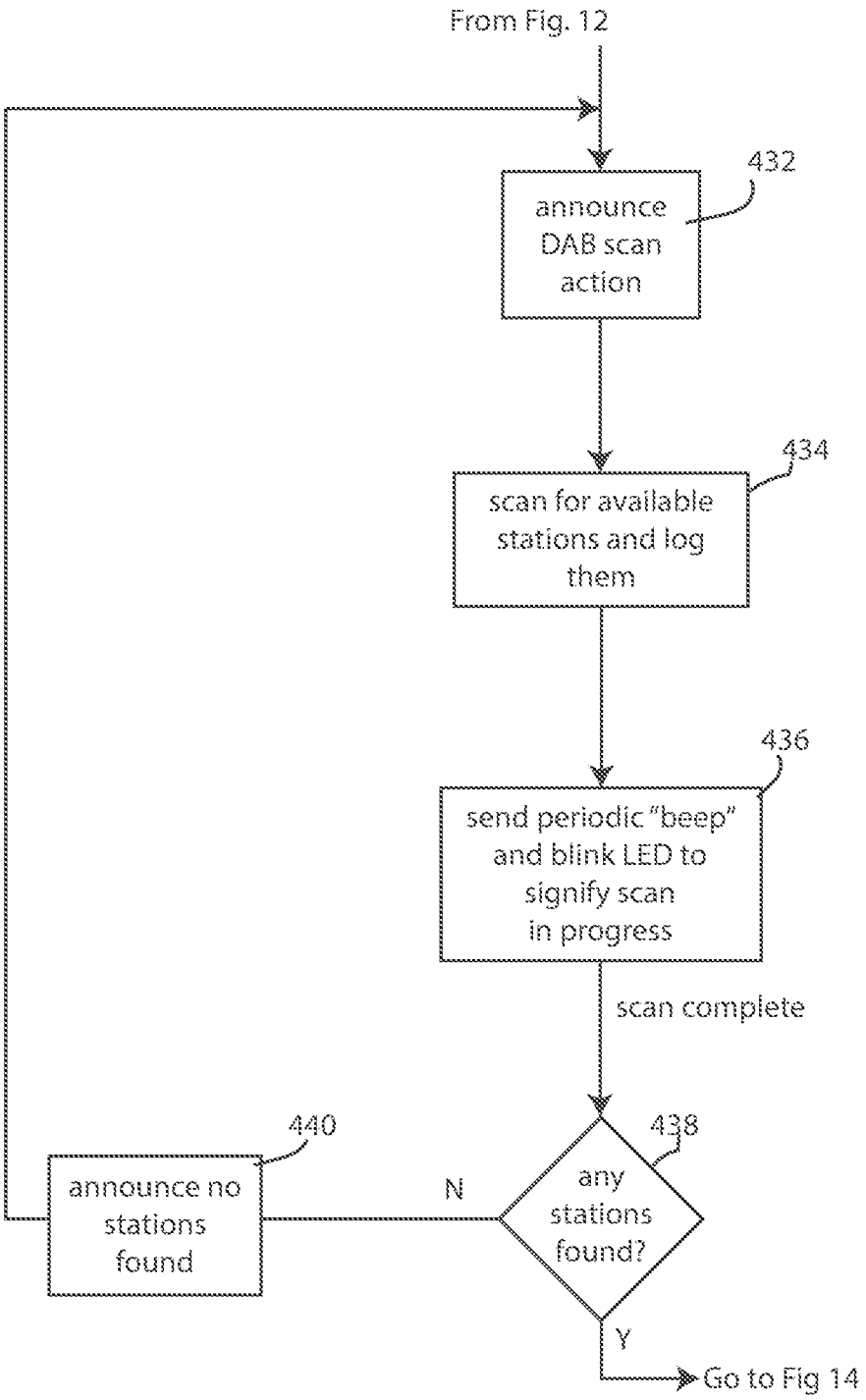
FIG. 13 is a flowchart depicting the process performed by the microcontroller in support of the station scanning operation.

Referring to FIG. 13, the microcontroller 200 performs the requested action by announcing the DAB scan action at 432. Specifically, the microcontroller 200 uses annunciate to the user that the scan action has been initiated. Next, at 434, the microcontroller sends a command to the radio to cause it to scan for all available stations and enter them into a data structure in memory. While the scan is in process, the microcontroller, at 436, sends a periodic "beep" annunciation and may also optionally blink an LED to signify that the scan is in progress. In some vintage radios, it may be possible to position an LED within the case of the legacy radio, so that light emanating from the LED is visible through the glass of the legacy tuning dial. In other implementations, particularly where the user does not desire any visible modification to the radio, the LED can be omitted, masked or disabled.

Figure 14:
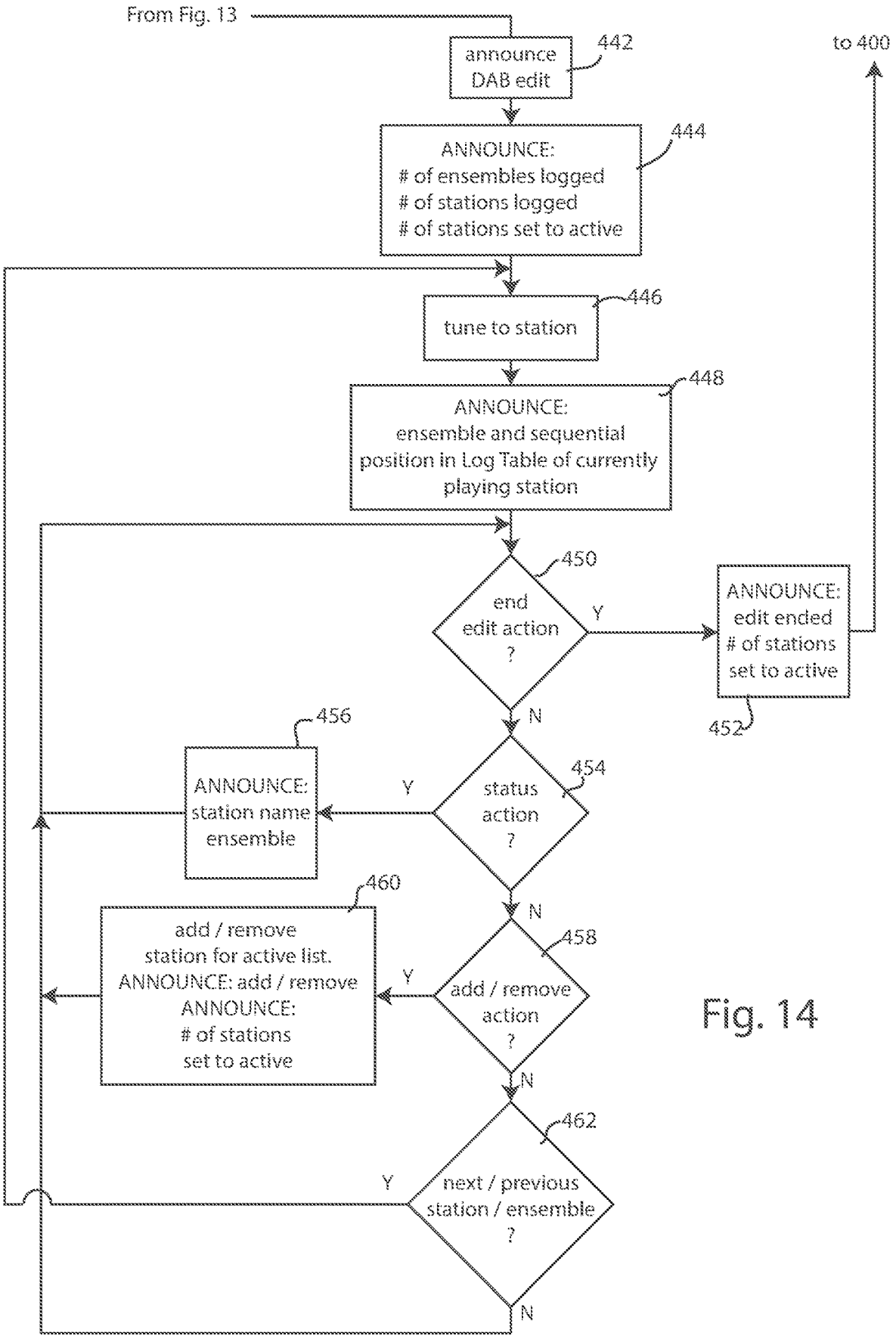
FIG. 14 is a flowchart depicting the process performed by the microcontroller in providing annunciations (announcements) to the user in support of the station scanning and editing operations.

At step 438, if any stations have been found during the can, the microcontroller proceeds to process the steps shown in FIG. 14. If no stations were found, the microcontroller at 440 announces that no stations were found and control loops back, whereupon a new scanning action is initiated.

FIG. 14 shows the logic resulting from the microcontroller 200 having decoded that a DAB edit action was commanded at step 430 (FIG. 12). The microcontroller, at step 442, announces that the DAB edit action is pending, followed in step 444 with an announcement of the number of ensembles logged, the number of stations logged and the number of stations set to active. Then the microcontroller tunes to a station at 446 and announces at 448 both the ensemble identity and the sequential position in the Active Stations list of the currently playing station.

If the microcontroller beginning at step 450 parses the state of the edit action being performed by the user. Step 450 defines the beginning of an action parsing loop that includes steps 454, 458 and 462. If the user has exited the edit action state at 450, the microcontroller announces the edit has ended and then announces the number of stations that have been set to active (i.e., number of stations in the Active Stations list).

If the user entered command was a request for status, the microcontroller detects this at 454 and issues an announcement at 456, giving the station name and ensemble identity.

If the user entered command was a request to add or remove a station, the microcontroller detects this at 458 and thereafter performs the requested station add or remove operation. The microcontroller also at 458 announces the identity of the station added or removed, and then announces the number or stations on the Active Stations list.

If the user entered command was a request for the next or previous station or a request for the next or previous ensemble, the microcontroller detects this at 462 and passes control to the station tuning point at 446 (if the user has not requested a next or previous station or ensemble), and otherwise to the entry point of the command parsing loop at 450 (if the user has requested a next or previous station or ensemble).

Mapping Digital Stations to the Legacy Analog Tuning Dial

Figure 9:
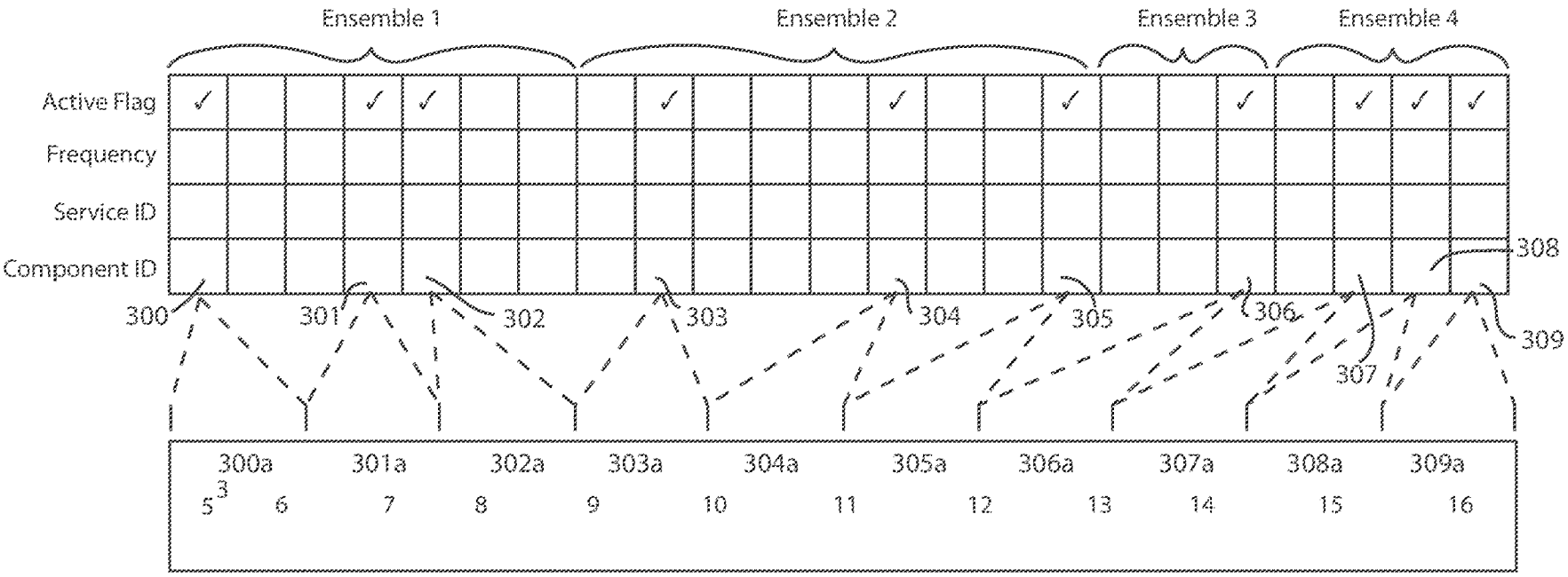
FIG. 9 is a diagram explaining how channels are distributed across the legacy band, and where the comfort noise is injected by the electronic circuit.

The microcontroller 200 is programmed to associate, assign or map each of the detected digital stations of the channel list, discovered during a scanning operation, to a different positional setting of the control device. This has been illustrated in FIG. 9. In FIG. 9, DAB content components 300-309 have been associated, assigned or mapped to different individual analog dial tuning positions 300*a*-309*a*. As illustrated, only components that have been designated as "active" are mapped to the analog tuning dial. See the "active flag" field in FIG. 9. In one embodiment, a user can select which digital stations are deemed active by sending a suitable command to the microcontroller using one of the bidirectional movement commands depicted in FIG. 10, discussed below.

The microcontroller 200 performs this mapping function by performing a calculation that divides the span of the legacy dial into equally-spaced slots and then assigns each of the active DAB components to a different one of these slots.

Advanced User Interaction Via Legacy Controls

Unlike today's digital consumer electronic devices, legacy radios have only a few control knobs, and when originally designed, these control knobs provided control over analog functions such as adjusting audio treble-bass tone, increasing or decreasing audio volume, and tuning the radio to a particular frequency from a continuous range of frequencies. In the disclosed electronic conversion circuit, microcontroller 200 is programmed to repurpose these legacy control knobs to perform additional functions, such as: to place the electron conversion circuit into a setup mode useful in deleting all previously memorized stations so that a fresh set of stations can be captured; to allow the user to cause the electronic conversion circuit to scan for available stations in the user's area; and to allow the user to edit an Active Stations list representing only the available stations the user is interested in tuning.

FIG. 10 shows one embodiment of how the microcontroller 200 is programmed to map various control functions onto different manipulations of the TONE, VOL and TUN knobs of the legacy radio. For each of these legacy control knobs, microcontroller 200 interprets different sequences of angular rotation of the knob as a different control instruction. In the illustrated embodiment, six different angular rotation sequences are depicted: single, double or triple knob-twists counterclockwise, and single, double or triple knob-twists clockwise (depicted at reference numerals 500-530 in FIG. 10). In the one embodiment, the microcontroller issues annunciations, such as digitized voiced announcements played through the radio speaker to let the user verify that the control instruction was recognized. The microcontroller can also issue annunciations to provide additional information to the user, such as how many ensembles and stations have been identified. As next described, the user uses the control knobs to initiate and control the Setup, Scan and Edit modes. Typically these operations may be performed as three separate steps, as follows.

Step 1: DAB Setup

The user puts the radio in DAB Setup mode by triple twisting the tone control clockwise, as shown at 510. The microcontroller 200 will then issue an announcement to signify when the radio enters DAB Setup mode. The microcontroller 200 is programmed so that within 8 seconds, at least one of the DAB Scan mode 508, DAB Edit mode 510, or Clear All Stations mode 528 commands must be entered. If not, the microcontroller exits the DAB Setup mode and an announcement will be heard.

The Clear All Stations mode 528 is useful when moving to a new area, where the user wishes to remove all prior scanned stations from the radio. Note this will clear all stations from the radio, so that subsequent Scan and Edit operations will be required.

Step 2: DAB Scan

In the DAB Scan mode 508 the microcontroller starts the radio scanning for new stations. To enter the DAB Scan mode, the user must within 8 seconds of entering DAB Setup mode, triple twist the tone control as shown at 508. The microcontroller then issues an announcement and a front panel status LED will blink to signify the radio is scanning for available stations. The microcontroller also issues a periodic beep to signify scanning is in progress. This scanning process may take several minutes to complete depending on the number of ensembles and stations in the user's area. If no stations are found the scan will automatically start over.

All stations logged during a scanning operation are stored in memory allocated to contain the Active Station list. Stations that are logged during this scan operation can only be updated by another Scan or by the Clear All Stations action 528.

Step 3: DAB Edit

In the preceding DAB Scan step, all stations and ensembles found during scanning are stored in the Active Station list. In some instances, a user may wish to prune down the list to only those stations he or she is interested in. Operations performed within the DAB Edit mode allow the user to customize the Active Station list, by adding or removing stations that were found during a Scan. Only the Active Station list is modified during this step. Stations that were logged during a scan are not modified.

To enter the DAB Edit mode, within 8 seconds of entering DAB Setup mode, the user triple twists the tone control as shown at 510. In one embodiment, the Edit mode is automatically entered after a Scan is completed. Upon entering the DAB Edit mode, the microcontroller issues a verbalized announcement providing the following information:

Number of currently logged Ensembles

Number of currently logged Stations

Number of stations currently set to Active.

In one embodiment, the radio may be designed to present up to a first predetermined number of active stations (e.g., up to 50 active stations) across the tuning dial. If less than this predetermined number of stations were found during the Scan, all will be initially marked as active. If more than the predetermined number were found during the Scan, up to a second predetermined number of stations, less than the first predetermined number (e.g., 40 stations) will automatically be marked as active. In this case this lesser number is stored, to leave room for the user to add some additional stations through the Edit process.

In one embodiment, any stations that were previously marked as active that are found to match in a new Scan will automatically be marked as active. In this way, the user can rescan for new or changed stations without affecting the Active Stations list.

To aid the user in the Edit process, the radio will start playing the first station in the first Ensemble logged. It will also announce the Ensemble and the sequential position number in the log table to aid in the setup of the Active Stations. In this way the user can quickly determine if that station should remain in the Active Stations list or be removed. To remove a station while in the Edit mode, the user manipulates the TONE control as shown at 500. To add the station to the Active Station list, the user manipulates the TONE control as shown at 502. The microcontroller will annunciate the identity of the station that was added or removed and will then announce how many stations are currently in the Active Stations list. If the user tries to add a station that is already in the Active Stations list, or tries to remove a station that is not set to active, an error tone will be heard. Additionally if the user tries to add more than 50 stations to the Active Station list, an error announcement will be heard.

While in the Edit mode, the user can navigate between ensembles and stations within an ensemble by manipulating the TUN control knobs as follows:

Next Ensemble—manipulate the TUN knob as at 526

Previous Ensemble—manipulate the TUN knob as at 524

Next Station—manipulate the TUN knob as at 522

Previous Station—manipulate the TUN knob as at 520

In one embodiment, while parsing through the stations, the sequential position number is announced. Additionally when changing between Ensembles, the Ensemble channel is announced. Also, during Edit, the microcontroller may also issue a status voice assist action that will announce the first few letters of the station name followed by the Ensemble channel number.

DAB Setup End

At any time, triple twisting the tone control as shown at 508 will end Setup, returning the radio to normal operation. If the radio was in Edit mode when Setup ends, the final number of stations set to active will also be announced.

In addition to the control manipulations to initiate DAB Setup, DAB Scan and DAB Edit operation, as discussed above, the microcontroller 200 can also provide control of other functions such as, for example, reporting a signal-to-noise (SNR) value, reporting received signal strength, turning on-off automatic volume control (AVC), and other optional control functions. These would be selectively mapped to some of the unused control manipulations (e.g., 504, 506, 512, 514, 516, 518 and 530 in FIG. 10).

During Normal Radio Operation

Operation of the radio with the electronic conversion circuit installed is virtually the same as a standard analog AM/FM radio in many respects. However, because DAB digital radios take a second for the audio to be heard, the microcontroller injects a "plink" sound into the audio stream between stations to aid in tuning. The microcontroller may also inject a low level hiss or white noise (comfort noise) between stations, to provide the user with a familiar experience of tuning a standard analog AM/FM radio.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment as contemplated herein. It should be understood that various changes may be made in the function and arrangement of elements described in an exemplary embodiment without departing from the scope of the invention as set forth in the appended claims.

What is claimed is:

1. A circuit for adapting a legacy radio to play digital broadcasts, the legacy radio having at least one manually manipulable control device associated with a tuning dial displaying a span of contiguous tuning frequencies, and the digital broadcasts having associated with a carrier frequency an ensemble of plural stations each station providing different digital streaming content components, the circuit comprising:

a sensing circuit coupled to the control device of the legacy radio, the sensing circuit produces a signal indicative of the positional setting of the control device;

a processor coupled to the sensing circuit and programmed to detect changes in the positional setting of the control device and to interpret a pattern of predetermined changes in the positional settings to generate at least one scan command;

a digital radio receiver circuit coupled to the processor and adapted in response to a scan command from the processor to tune to a reception frequency and perform a content scanning operation that accesses a data stream of the ensemble and to compile and communicate to the processor a channel list of detected digital stations;

the processor being programmed to associate each of the detected digital stations of the channel list to a different positional setting of the control device;

the processor being further programmed to interpret each different positional setting of the control device as a content selection command;

the digital radio receiver circuit being further adapted in response to a content selection command from the processor to select from the ensemble a particular digital streaming content a particular content component and cause the selected content to be played through an audio playback amplifier.

2. The circuit of claim 1 wherein the sensing circuit couples to the control device and produces a signal indicative of the positional setting of the control device without changing the original function of the control device as it pertains to the legacy radio.

3. The circuit of claim 1 wherein the control device includes a reactive tuning component and wherein the sensing circuit includes a complementary reactive component coupled to the reactive tuning component to define an LC network.

4. The circuit of claim 1 wherein the control device includes a reactive tuning component and wherein the sensing circuit includes a complementary reactive component selectively coupled to the reactive tuning component to define an LC network by the processor.

5. The circuit of claim 1 wherein the control device includes a reactive tuning component and wherein the sensing circuit includes a complementary reactive component selectively coupled to the reactive tuning component to define an LC network having an LC resonant frequency, and an oscillator coupled to the LC network that produces an oscillator frequency that changes according to the LC resonant frequency, and wherein the processor measures the oscillator frequency to acquire a signal indicative of the positional setting of the control device.

6. The circuit of claim 1 wherein the control device includes a resistive component and wherein the sensing circuit includes a circuit that applies a voltage across the resistive component and an analog to digital conversion circuit associated with the processor that produces a digital voltage measurement, and wherein the processor uses the digital voltage measurement to acquire a signal indicative of the positional setting of the control device.

7. The circuit of claim 1 wherein the control device produces a series of instantaneous values indicative of the positional setting and wherein the processor captures and stores the series of instantaneous values in a buffer.

8. The circuit of claim 1 wherein the control device produces a series of instantaneous values indicative of the positional setting and wherein the processor captures and stores the series of instantaneous values in a circular buffer that stores a predetermined number of the series of instantaneous values.

9. The circuit of claim 1 wherein the control device produces a series of instantaneous values indicative of the positional setting, wherein the processor captures and stores the series of instantaneous values in a buffer, and wherein the processor is programmed to detect changes in the positional setting by analyzing the instantaneous values stored in the buffer.

10. The circuit of claim 1 wherein the control device produces a series of instantaneous values indicative of the positional setting, wherein the processor captures and stores the series of instantaneous values in a buffer, wherein the processor is programmed to detect changes in the positional setting by analyzing the stored instantaneous, and wherein the processor is programmed to detect rotational movement: (a) in a first direction by observing an increase of the stored instantaneous values and (b) in a second direction by observing a decrease of the stored instantaneous values.

11. The circuit of claim 1 wherein the processor is programmed to detect different patterns of rotational movement of the control device and to associate those different patterns of rotational movement with different meta-commands that provide supervisory control over the functioning of the digital radio receiver circuit.

12. The circuit of claim 11 wherein the different patterns of rotational movement comprise different classes of movement selected from the group consisting of mono-directional movements, bidirectional movements and combinations thereof.

13. The circuit of claim 1 wherein the processor polls the signal indicative of the positional setting of the control device at a predefined sampling rate to capture changes in the positional setting indicative of velocity and direction of rotation of the control device.

14. The circuit of claim 1 wherein the processor polls the signal indicative of the positional setting of the control device at a predefined sampling rate to capture changes in the positional setting indicative of velocity of rotation of the control device and wherein the processor is programmed to ignore rotational movements of the control device.

15. The circuit of claim 1 wherein the processor polls the signal indicative of the positional setting of the control device at a predefined sampling rate to capture distance of travel of the control device during a rotational motion, and wherein the processor is programmed to compare the distance traveled against predetermined thresholds and to ignore rotational motion based on the comparison.

16. The circuit of claim 1 wherein the processor is programmed to map a plurality of digital stations to different positions on the tuning dial by performing a calculation that divides the span of the tuning dial into equally-spaced slots and then assigning each of the plurality of digital stations to a different one of the slots.

17. The circuit of claim 1 further comprising an annunciator circuit that generates a brief audible sound when a digital station is tuned through manipulation of the control device.

18. The circuit of claim 1 further comprising an annunciator circuit that generates a brief a comfort noise hiss between tuned stations to simulate the background noise as would be present in an analog radio.

* * * * *